United States Patent [19]

Appelberg

[11] Patent Number: 5,045,755

[45] Date of Patent: Sep. 3, 1991

[54] ELECTROLUMINESCENT PANEL LAMP WITH INTEGRAL ELECTRICAL CONNECTOR

[75] Inventor: Gustaf T. Appelberg, Fairfield, Conn.

[73] Assignee: E-Lite Technologies, Inc., Watertown, Conn.

[21] Appl. No.: 469,098

[22] Filed: Jan. 24, 1990

Related U.S. Application Data

[63] Continuation of Ser. No. 54,532, May 27, 1987, abandoned.

[51] Int. Cl.[5] ..... H05B 33/06

[52] U.S. Cl. ..... 313/498; 313/506; 313/49; 313/51; 439/858; 439/924

[58] Field of Search ..... 313/49, 51, 498, 506; 439/59, 60, 62, 830, 858, 861, 924

[56] References Cited

U.S. PATENT DOCUMENTS

| | | | |
|---|---|---|---|
| 2,855,531 | 10/1958 | Nicoll | 313/506 |
| 4,513,023 | 4/1985 | Wary | 313/503 |
| 4,522,211 | 6/1985 | Bare et al. | 439/325 |
| 4,534,743 | 8/1985 | D'Onofrio et al. | 427/66 |
| 4,617,195 | 10/1986 | Mental | 313/498 |
| 4,721,883 | 1/1988 | Jacobs et al. | 313/505 |

*Primary Examiner*—Palmer C. DeMeo

*Assistant Examiner*—Michael Horabik

*Attorney, Agent, or Firm*—McCormick, Paulding & Huber

[57] ABSTRACT

An electroluminescent panel lamp being of either a split-electrode or parallel plate type is disclosed wherein the lamp consists of a main body having an electroluminescent layer between first and second conductive layers. An integral electrical connector tab is formed from the materials of the main body. In the parallel plate embodiment the first conductive element is exposed so as to form a front electrode, the rear electrode being the second conductive layer. In the split-electrode embodiment, the second conductive layer on the main body and connector tab is split into two halves, the two halves on the tab being the electrical connections and lying in the same plane. An alternating current charge applied to one half of the split second conductor will capacitively couple it to the other half through the unconnected first conductor. A universal connector that can connect an electrical power source to either the parallel plate or split-electrode embodiment is also disclosed. The connector has a pair of spaced apart contact fingers of different lengths that contact the front and rear electrodes of the parallel plate lamp or both halves of the second conductor in the split electrode lamp.

20 Claims, 4 Drawing Sheets

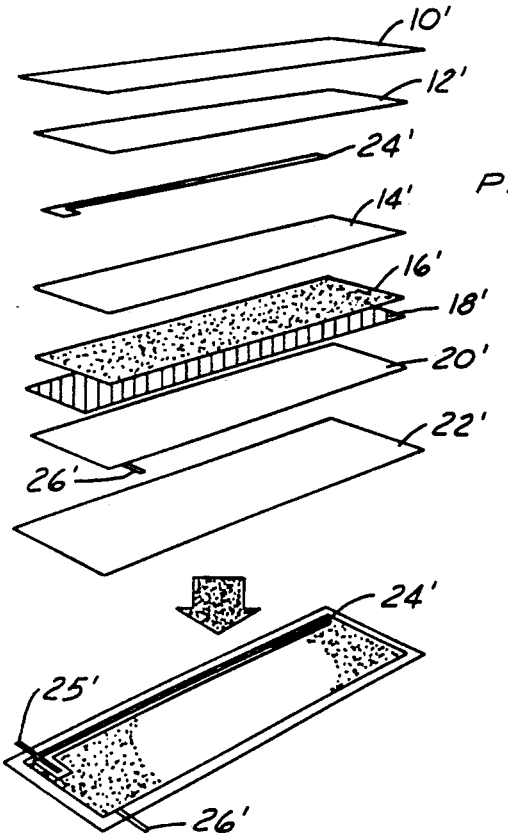
FIG. 1
PRIOR ART
FIG. 3
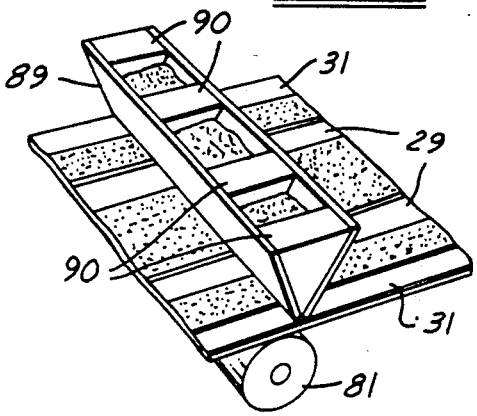
FIG. 2
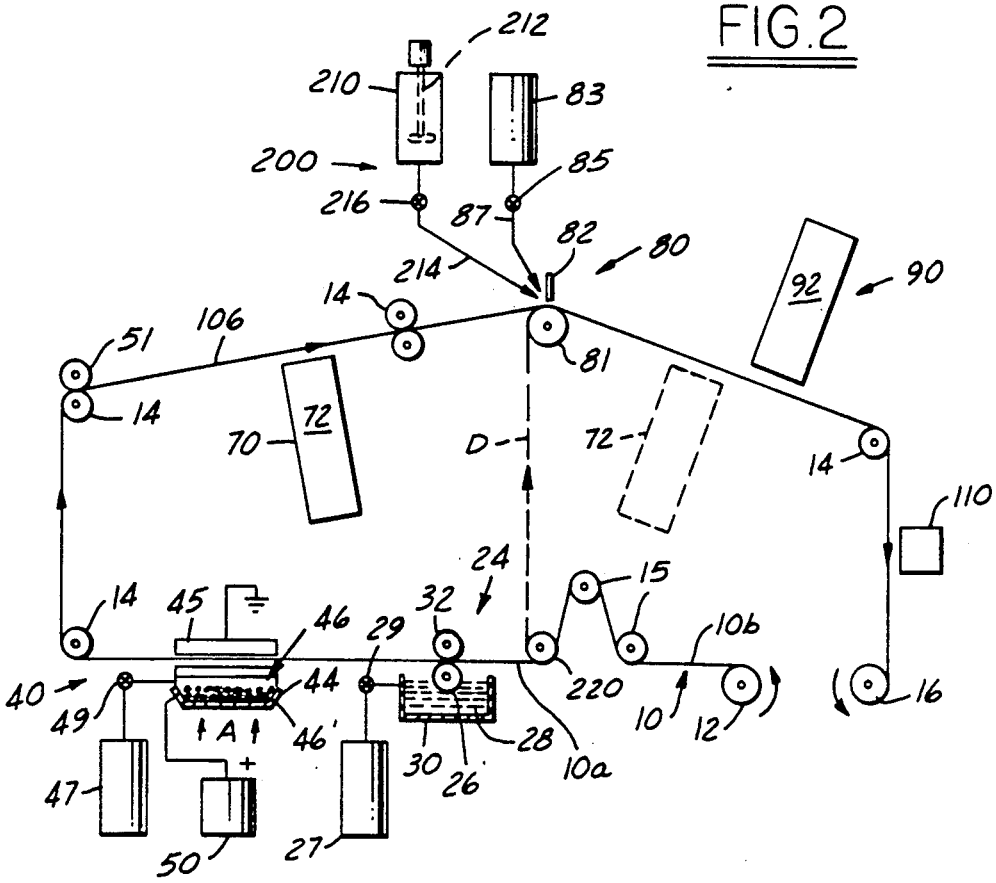

ELECTROLUMINESCENT PANEL LAMP WITH INTEGRAL ELECTRICAL CONNECTOR

This is a continuation of co-pending application Ser. No. 054,532 filed on May 27, 1987 now abandoned.

FIELD OF THE INVENTION

The invention relates to electroluminescent panel lamps and methods for manufacturing same. An electrical connector system for parallel plate and split electrode type electroluminescent panel lamps is also disclosed.

BACKGROUND OF THE INVENTION

U.S. Pat. No. 4,534,743 issued Aug. 13, 1985, to Anthony D'Onofrio and Walter Kitik describes a process for making flexible split-electrode electroluminescent lamps by applying required lamp component layers in succession on a carrier strip which itself becomes part of the lamp. The disclosed process involves depositing a slurry of uncured epoxy resin and electroluminescent phosphor particles on a transparent conductive coating (indium-tin oxide) previously applied to a transparent flexible insulating carrier strip (MylarR strip). The slurry coated strip is passed through a curing oven to cure the epoxy resin to bond the phosphor particulate in a flexible matrix and to adhere it to the coated carrier strip. Then, a slurry of liquid-borne conductive particulate is continuously deposited on the cured strip and the slurry dried to provide a second continuous coating of electrically conductive material; e.g., a nickel-filled acrylic coating. The laminated panel is then subjected to the split-electrode forming steps described in the patent. In the embodiment shown in FIGS. 7–10 of the patent, the transparent first conductive layer on the carrier strip is shielded in areas across the strip and a single electroluminescent slurry layer is applied between shielded areas, leaving side strips of the first conductive coating exposed for contact with separate electrical connector members. Copending application Ser. No. 940,794 entitled "Method for Manufacturing An Electroluminescent Panel Lamp As Well As Panel Lamp Produced Thereby" filed Dec. 12, 1986, now abandoned and of common inventorship herewith describes a method for making an electroluminescent panel wherein either dry phosphor particulate or a phosphor slurry is deposited on a first dielectric phosphor covering either a front or rear electrode layer on a moving carrier strip. The dry phosphor particulate is electrostatically deposited followed by deposition of a second dielectric layer over the phosphor layer. The first and second dielectric layers are cured by U.V. radiation to encase the phosphor in a dielectric mass. The other electrode of the electroluminescent panel is placed adjacent the cured second dielectric layer; e.g., the other electrode can be vapor deposited on the cured second dielectric layer.

Other prior art workers have used a different process to manufacture individual electroluminescent lamps on a non-continuous basis in that a continuously moving carrier strip is not used during the entire manufacturing process. In particular, prior art workers have deposited barium titanate in a solvent based slurry on a moving aluminum foil in a continuous process. The deposited barium titanate layer or coating is thermally cured. Phosphor in a solvent based slurry is then deposited on the cured barium titanate layer in a continuous process as the foil moves. The phosphor slurry is then cured using thermal curing. The foil is then cut into sections or pieces about 12 inches by 12 inches and a slurry of transparent indium tin oxide (ITO) is deposited in areas that are to become lamp elements on each section by silk screening followed by a thermal cure. A bus bar is deposited on each ITO coated area by a slurry and silk screening process and thermally cured. Individual lamp sections that in FIG. 1 hereof are the united elements 17, 19, 21, 23, and 27 are then cut or separated from the large sections. A front electrical lead is attached to the bus bar and a rear electrical lead is attached to the rear foil. Final assembly involves placing a front plastic cover over the bus bar and ITO layer with a dessicant layer therebetween and a rear plastic cover over the rear foil electrode. The front and rear plastic covers are tack welded at several places and the assembly then is stored in a dry room (humidity of 10% and temperature of 120° F.) for three days. Following drying, the edges of the front and rear plastic covers are heat sealed around the entire periphery. FIG. 1 illustrates such an electroluminescent lamp construction comprising a front plastic cover 11, a dessicant layer 13, transparent front ITO electrode 17, phosphor layer 19, reflective barium titanate layer 21, rear aluminum electrode 23 and rear plastic cover 25. Bus bar 27 is attached to front electrode 14' and front lead 9 is attached to the bus bar. Rear lead 7 is attached to foil electrode 23. U.S. Pat. No. 2,728,870 describes a process for increasing light output of an electroluminescent lamp by heating the cured resin/phosphor layer after deposition on a substrate to the melting temperature of the resin while subjecting the heated layer to a D.C. electric field to impart a common alignment to the phosphor particles after cooling of the layer.

Technical article entitled "High Brightness Electroluminescent Lamps of Improved Maintenance" published by R. J. Blazek in Illuminating Engineering, November, 1962, provides information on construction of electroluminescent lamps and factors affecting their brightness or light output.

Similarly, a technical article entitled "Lasers, EL, and Light Value" published in Display systems Engineering, pp. 379–391, 1968, discusses factors which affect performance of electroluminescent lamps.

SUMMARY OF THE INVENTION

The present invention contemplates a method for making multiple electroluminescent panel lamps including the steps of depositing multiple electroluminescent layers side-by-side on a first conductive layer, preferably on a moving carrier strip, with each electroluminescent layer having a second conductive layer thereon to form an electroluminescent strip while separating each such strip from an adjacent similar strip by a space where the first conductive layer is exposed and uncovered so as to form multiple electroluminescent panel strips separated from one another by the aforementioned space. The final step involves cutting the panel strips into multiple electroluminescent panel lamps of desired dimension.

The present invention also contemplates cutting either the multiple electroluminescent panel strips of the preceding paragraph or an individual electroluminescent panel strip to form a panel lamp having a main body of desired dimensions and an electrical connector engaging portion or tab extending integrally from the main body.

In one preferred embodiment for a parallel plate panel lamp, the electrical connector engaging portion or tab includes an exposed area of first conductive layer and an exposed area of second conductive layer. The exposed areas are contacted by different contacts of an electrical connector to enable a suitable driving voltage to be applied between the first and second conductive layers with the electroluminescent layer therebetween.

In another preferred embodiment for a split electrode panel lamp, the electrical connector engaging portion or tab includes an area of first conductive layer, electroluminescent layer and a second conductive layer in lamellar form with the second conductive layer having a slit or groove therethrough to form split apart side-by-side second conductive layers on the portion or tab. The split apart areas of the second conductive layer on the connector engaging portion or tab are contacted by different contacts of an electrical connector to enable a suitable driving voltage to be applied between the split apart side-by-side second conductive layers.

The present invention also contemplates an electrical connector adapted for engaging the connector engaging portion of the electroluminescent panel lamp. To this end, the electrical connector includes a first contact and second contact spaced laterally apart and of different lengths. The lengths of the contacts are selected different for use with the parallel plate panel lamp so that one contact engages the exposed area of second conductive layer and the other engages the exposed area of first conductive layer. Typically, the exposed area of the first conductive layer is remote from the main body of the panel lamp while the exposed area of the second conductive layer is adjacent the main body.

The lateral spacing of the first and second contacts is selected to be sufficient for one contact to engage one split apart section of the second conductive layer on the connector engaging portion and the other contact to engage the other split apart section of the second conductive layer for the split electrode type of panel lamp. Thus, the electrical connector of the invention can be used to electrically engage the connector engaging portion or tab of either the parallel plate panel lamp or split electrode panel lamp of the preceding paragraphs.

BRIEF DESCRIPTION OF THE DRAWINGS

FIG. 1 is an exploded view together with a perspective view of a prior art parallel plate electroluminescent lamp.

FIG. 2 is a schematic view of apparatus for practicing the method of the invention.

FIG. 3 is a partial enlarged schematic view of the knife-over roller depositor.

BEST MODE FOR PRACTICING THE INVENTION

Figure 4:
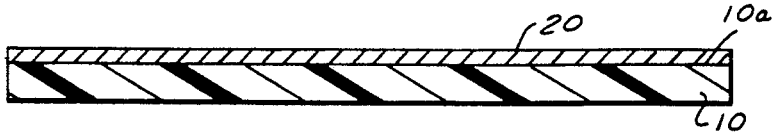
FIG. 4 is a cross-sectional view of the carrier strip with first transparent conductive layer thereon.

The preferred forms of the process of the invention and resulting electroluminescent panel are shown in FIGS. 2 through 19. In FIG. 2 there is provided a continuous carrier strip 10 of transparent insulating plastic material which is conveniently stored on a payoff roll 12. Means are provided to uncoil the carrier strip from roll 12 and drive it through a series of guide and strip alignment rolls 14 and tension adjustment and control rolls 15 and strip alignment means (not shown but of known construction) and ultimately to coil the strip on take-up roll 16 at the other end of the line. A conventional motor drive (not shown) continuously moves the carrier strip 10 at a substantially continuous speed which may be selected in the range of about 10–20 feet per minute. The carrier strip 10 of transparent insulating material is preferably Mylar, a registered trademark of E. I. duPont de Nemours and Co., preferably having a thickness of about 5 mils (0.005 inch). The width of the Mylar carrier strip 10 may be in the range of 24 inches to 60 inches and have a typical length of 500 to 900 feet.

A first continuous thin transparent coating 20 of electrically conductive material is provided, for example by sputtering, on side 10*a* of the carrier strip 10, FIG. 4. The conductive coating 20 may be indium-tin oxide having a thickness of about 400 Angstroms. Mylar strip with such a transparent conductive coating is commercially available in strip form under the name of "Intrex", a registered trademark of Sierracin Corporation. Typical coated Mylar strip thickness is about 5 miles (0.005 inch).

Figure 5:
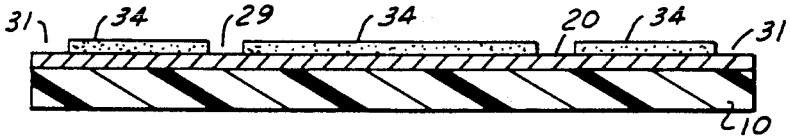
FIG. 5 is similar to FIG. 4 after a first dielectric adhesive has been deposited on the first conductive layer in the form of multiple stripes extending along the length of the carrier strip.

Carrier strip 10 moves continuously from payoff roll 12 past adhesive applying device or station 24 with the side 10*a* facing downwardly in FIG. 2 toward adhesive applying roll 26 which picks up liquid radiation-curable dielectric adhesive 28 from container 30 for application as thin layers 34 on the conductive coating 20 on side 10*a* by rolling contact between side 10*a* and roll 26. As will be explained hereinafter, the side-by-side layers 34 of dielectric adhesive extend along the length of carrier strip 10. As best seen in FIG. 5, spaces or lineal bands 29 separate the side-by-side adhesive layers 34 and side spaces or lineal bands 31 are left adjacent the most laterally remote layers 34. In the spaces 29 and 31, the first transparent coating 20 is left uncoated and thus is exposed as shown. An upper biasing roll 32 insures contact between side 10*a* and adhesive applying roll 26. An adhesive reservoir 27 supplies adhesive to container 30 as controlled by control metering valve 5. The adhesive device 24 is of the rotogravure type and provides precise control of the thickness of the thin transparent adhesive strips or layers 34 on conductive coating 20. A typical thickness for first adhesive layer 34 is about 0.3–0.5 mils (0.0003–0.0005 inch). First adhesive layer 34 (as cured) is a high dielectric strength adhesive such as, for example, Magnacryl UV2601 Epoxy available commercially from Beacon Chemical, 125 MacQuesten Parkway, Mount Vernon, N. Y. 10550. Such adhesive has a high dielectric strength of about 2200 volts per mil of thickness. At a 0.3 mil layer thickness, first dielectric adhesive layer 34 (as cured as described hereinbelow) provides about 660 volts protection to conductive coating 20 and the rear electrode to be described which voltage value is greater than three times the voltage to be applied to the lamp to operate same. Adhesive layer 34 is applied in liquid form (viscosity of 700 CPS) to conductive coating 20 and is curable subsequently by radiation; e.g., ultraviolet light of selected wave length as will be described.

As will be apparent to one skilled in the art, the rotogravure roll 26 will have circumferential grooves (not shown) in its working surface of proper axial spacing from one another to apply the adhesive strips or layers 34 as shown in FIG. 5. The lateral width W1 and W2 of spaces 29 and 31 as well as W3 and W4 of adhesive strips 34 and preselected for purposes to be explained, see FIG. 9.

Alternatively, the striped pattern of layers 34 can be achieved by mechanically applying tape or resist to the conductive layer 20 to provide a striped pattern and then coating side 10*a* with a standard rotogravure roll. The tape or resist is removed at the end of processing to provide spaces 29, 31.

The carrier strip 10 with conductive coating 20 and first uncured dielectric adhesive layer 34 thereon is shown in FIG. 5. The total thickness of the lamp layers at this point in fabrication is the aggregate of 0.005 in for strip 10 and coating 20 plus 0.0003–0.0005 inch for first dielectric adhesive layer 34.

The adhesive depositing device 24 useful in the practice of the invention is known commercially as "Chart-pak Coater" available from Magnat Corp., North Maple Street, Florence, Mass. 01060.

The carrier strip 10 with conductive coating 20 and first uncured dielectric adhesive layer 34 is then moved continuously past the phosphor particulate depositing device or station 40 which includes a phosphor source such as a fluidized bed or batch 46 of dry phosphor particulate of particle size preferably not exceeding 400 mesh (38 micron maximum size) for the zinc sulfide particles used. The phosphor particulate is purchased from GTE Corporation, Stamford, Conn., in batches not to exceed 400 mesh which corresponds to sieve opening of 38 microns. Of course, such batches include phosphor particles of size less than 38 microns. For example, particle sizes down to 5–6 microns are present in such batches and are referred to herein as "fines" or "tailings". As explained in the aforementioned copending application Ser. No. 940,794 entitled "Method For Manufacturing An Electroluminescent Panel Lamp As Well As Panel Lamp Product Thereby" of common inventorship and the teachings of which are incorporated herein by reference, the mesh size of the phosphor particulate used as the preferred thickness of the phosphor layer is controlled to coincide with that of the largest phosphor particulate present in the batch or bed 46. Of course, it may be possible to use electroluminescent phosphor particulate other than zinc sulphide and of other sizes although phosphor particles of about 50 microns or less diameter (or largest dimension) are preferred with about 400 mesh (38 micron) particulate being most preferred. As shown best in FIG. 2, the fluidized bed 46 includes a sintered metal pan 44 in which the dry phosphor particulate 43 is disposed and fluidized by air flow A from beneath.

In addition to fluidized bed 46, the phosphor particulate depositing device 40 includes means for establishing an electrostatic field between the carrier strip and pan 44 so that the phosphor particulate is electrostatically deposited on or attracted to first uncured adhesive layer 34 which faces the pan 44. In particular, the pan 44 is connected to a voltage source 50 to make the pan positive (e.g. 45,000 volts) relative to the carrier strip which is held at ground potential by contact with grounded guide rollers 14 and also by contact with an aluminum grounding plate 45 located directly above the phosphor particulate source 46. A suitable electrostatic phosphor depositing device for the invention commercially from Electrostatic Technologies Corp., 80 Hamilton Street, New Haven, Conn. 06511.

Reservoir 47 contains phosphor particulate of 400 mesh and provides particulate to bed 46 as metered by conventional valve 49.

As a result of electrostatic deposition of the charged phosphor particulate 46 on the first uncured dielectric adhesive layer 34 on grounded carrier strip 10, the phosphor particles are deposited in an approximate monolayer 60; i.e., a layer whose thickness preferably does not exceed the thickness or diameter of the largest particle in bed 46 without substantial large particle stacking on top of one another but instead with the larger phosphor particles positioned substantially side-by-side in a plane parallel with the plane of the carrier strip across and embedded substantially into the first uncured dielectric adhesive layer 34. Such phosphor particulate mono-layer 60 extends uniformly across each of the first adhesive strips or layers 34 with near 100% surface density except for interstitial voids between the side-by-side particles resulting from their different shapes or profiles from one particle to the next as is apparent. Smaller size particles (tailings) are deposited and lodge between the large size particles during the electrostatic deposition process.

Figure 6:
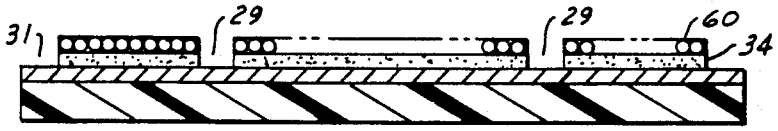
FIG. 6 is similar to FIG. 5 after electrostatic deposition of dry phosphor particulate on each stripe of dielectric adhesive.

Since there is no adhesive layer 34 in spaces 29 and 31 phosphor particulate is not deposited in the spaces on first conductive coating 20 as is clearly shown in FIG. 6.

Embedding of the phosphor particles is aided by roll 51 (Teflon coated and height adjustable) and is substantially such that the aggregate thickness of adhesive layer 34 and embedded phosphor particulate layer 60 is considered about 0.0016 inch. The thinness of the near mono-layer 60 and the aggregate thickness of layers 34,60 allow conductive coating 20 and the rear electrode (to be described) to be spaced apart closely to one another so as not to require excessive voltage to drive the lamp.

Furthermore, since the zinc sulfide phosphor particles may exhibit some polarity individually, the orientation of the electrostatically deposited phosphor particles of the mono-layer 60 will be similarly oriented from one particle to the next relative to the plane of the carrier and will increase lamp efficiency, light output and light output consistency across the lamp face during operation.

In lieu of a fluidized bed, the phosphor source 46 could include a rotatable positive polarity transfer wheel (not shown) which receives dry phosphor particulate from a phosphor particulate bed or reservoir and rotates at a desired speed in spaced depositing relation to side 10*a* to electrostatically deposit the near mono-layer 60 of other layer of phosphor particulate on side 10*a*.

Following electrostatic deposition of the phosphor particulate layers 60 on adhesive strips 34, the carrier strip is moved continuously past curing device or station 70 comprising an ultraviolet lamp 72. Lamp 72 is disposed on side 10*b* of the carrier strip which is opposite to side 10*a* on which coating 20, first adhesive layer 34 and phosphor mono-layer 60 are deposited in succession. Lamp 72 is selected to have a power and wave length to cure first dielectric adhesive layer 34 from side 10*b* with the ultraviolet light passing through the Mylar strip and conductive coating 20 to reach layer 34 to cure same. To cure first adhesive layer 34 described above, an ultraviolet lamp known as a "D" lamp commercially available from Fusion Systems Corp., 7600 Standish Place, Rockville, Md. 20855 has been found useful. Lamp 72 cures transparent first adhesive layer 34 in a rapid manner as the carrier strip passes by the lamp at the 10–20 feet per minute line feed. The cured dielectric adhesive layer 34 holds the phosphor particulate mono-layer 60 thereon as the carrier strip is removed to the next adhesive filler depositing device or station 80.

Depositing device or station 80 preferably is a known knife-over roller depositor having roll 81 and knife 82 closely adjacent carrier side 10*a* to apply thin radiation curable adhesive or filler strips or layers 84 on the phosphor layer 60 and around the particles thereof as adhesive or filler is fed from reservoir 83 by metering valve 85 in supply 87. Such as knife-over roller deposition is available from Magnet Corp; North Maple St., Florence, Mass. 01060.

Figure 7:
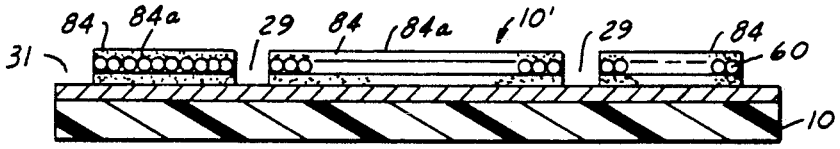
FIG. 7 is similar to FIG. 6 after a second dielectric adhesive has been deposited on each stripe of phosphor particulate previously deposited on each stripe of first dielectric adhesive to form multiple electroluminescent layers or stripes.

A typical thickness for second dielectric adhesive or filler layers 84 is at least about 0.0003 inch above phosphor particulate mono-layer 60, FIG. 7. However, the second adhesive or filler layers 84 also penetrate and fill the interstitial voids between the side-by-side phosphor particles to surround and cover the particles, all as explained in the aforementioned copending application Ser. No. 940,794 entitled "Method For Manufacturing An Electroluminescent Panel Lamp As Well As Panel Lamp Produced Thereby", the teachings of which are incorporated herein by reference. The second adhesive layers 84, when cured, embed or encapsulate the phosphor particles of each layer 60 in a high dielectric constant flexible matrix that exhibits a low moisture absorption and transmission rate. Thus, each second transparent adhesive or filler layer 84 (as cured as described hereinbelow) is a high dielectric constant adhesive such as, for example, Magnacryl UV 7632 Epoxy available commercially from Beacon Chemical referred to above or Epoxy 301-2 available from Epoxy Technology, Inc. Such adhesive or filler as cured has a high dielectric constant of about 8 or greater to promote increased storage of electrostatic energy and higher lamp output.

The knife-over roller depositor 80 includes a trough 89, FIG. 3, with laterally adjustable inserts 91 therein to deposit the second adhesive 84 in the proper striped pattern; i.e., over each deposited phosphor layer 60, FIG. 7, leaving spaces 29 and 31 remaining between the deposited strips. Inserts 91 prevent deposition of the second dielectric adhesive 84. Each deposited layer 34 of first dielectric adhesive, layer 60 of phosphor and layer 84 of second dielectric adhesive comprise an electroluminescent layer or stripe 101 extending along the length of carrier strip 20 on first conductive layer 10, see FIG. 9 to show the orientation on the carrier strip. Layers 34,84 of dielectric adhesive will function, when cured, as a dielectric matrix in which the phosphor particles are embedded.

As is apparent from FIG. 9, the multiple side-by-side electroluminescent layers, each layer 101 being covered by a metallic rear electrode 112 as described below, the combination of layer 101 and metallic rear electrode 112 forming electroluminescent panel strips 210, and 212 and 214 which are separated from each other by the uncoated spaces 29,31 where the first conductive layer 20 is exposed.

Second or filler adhesive 84 is applied in liquid form (viscosity of 700 CPS) to phosphor particulate strips or layers 60 to fill the interstitial voids and overcoat and is curable subsequently by radiation; e.g., ultraviolet light of selected power and wave length as will be described.

When cured at curing station or device 90 by movement of the carrier strip therepast, the second adhesive or filler layer 84 also provides a smooth outer surface 84*a* facing away from the mono-layer 60 for receiving a metallic rear electrode 112 as will be described. For example, second adhesive or filler layer 84, when cured, has a surface gloss on surface 84*a* of preferably about 50–60, 60 Gardner (i.e., smoothness of the cured surface 84*a* is measured by gloss using a Gardner glossmeter that shines light at a 60 angle on the surface). The reflection is measured on a scale of a 0–100 with 0 being the least smooth and .100 most smooth.

Curing station or device 90 comprises an ultraviolet lamp 92 of a power and wavelength to cure second uncured adhesive or filler layer 84 as the light is directed directly on to the layer 84 from side 10*b* of the carrier strip. To cure the layer 84 described above, an ultraviolet lamp known as an "H" lamp commercially available from Fusion Systems Corp. referred to above has been found useful.

Figure 8:
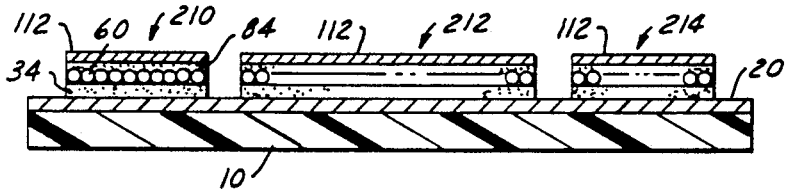
FIG. 8 is similar to FIG. 7 after an aluminum rear electrode layer has been vapor deposited on each electroluminescent stripe of FIG. 7.

After curing second adhesive or filler layer 84 to embed the approximate mono-layer 60 in the flexible first and second layers 34, 84 functioning as a dielectric matrix, the carrier strip 10 can be moved through a metallic deposition apparatus 110 for vapor deposition of thin reflective metallic conductive strips or layers 112 onto each surface 84*a* of each cured second dielectric layer 84, FIG. 8. A typical metallic layer 112 would comprise vapor deposited aluminum with a thickness of about 300 Angstroms. As mentioned above, the vapor deposited layer 112 will interface with high gloss smooth surface 84*a* and as a result of this interface and its higher vapor deposited purity provides a highly light reflective conductive rear electrode layer 112 that enhances the light output of the lamp. The aluminum layer 112 may be vapor deposited by well known conventional techniques.

In lieu of having the metallic deposition apparatus 110 in series alignment with the other components of the production line of FIG. 2, the apparatus 110 could be omitted and located elsewhere for depositing the layer 112 on surface 84*a*. In such a case, carrier strip 10 would be coiled on take-up roll 16 after ultraviolet curing of second adhesive dielectric layer 84. The coil would be transferred to the metallic deposition apparatus and uncoiled to pass through the apparatus 110 and recoiled after passing therethrough. Aluminum deposition for the purposes of this invention are available from Web Technologies, 27 Main Street, Oakville, Conn. 06002 and Scharr Industries, 40 E. Newberry Road, Bloomfield, Conn. 06002.

After vapor deposition of the aluminum layer 112, the total thickness of the carrier strip and all the layers thereon described above comprising the electroluminescent panel strips 210–214 will be about 0.007 inch.

Those skilled in the art will appreciate that although dry phosphor particulate deposited electrostatically has been described hereinabove, it may be possible to employ wet electrostatic deposition from liquids or slurries, so long as the layer 60 is effectively deposited onto the first adhesive strips 34.

Although the invention has been described hereinabove in connection with a continuous process using a moving carrier strip, it is apparent that the process does not need to be continuous in nature although continuous operation is preferred.

The apparatus for making an electroluminescent panel described hereinabove with respect to FIG. 2 is advantageous for large volume production of the panels.

For small production volume of electroluminescent panels, the apparatus includes optional slurry depositing device 201 for use in conjunction with the knife-over roller depositor 80. The optional device or equipment comprises a slurry reservoir 211 for a slurry of phosphor particles in uncured epoxy binder and a mixer 213 for maintaining a uniform as possible distribution of phosphor particulate in the slurry.

A slurry supply 215 conveys the slurry to the knife-over roller deposition 80 as controlled and metered by conventional valve 217.

In this mode of operation of the apparatus, the carrier strip 10 is diverted at roller 220 directly to the knife-over edge deposition 80 as shown in dashed lines "D".

At the knife-over roller depositor 80, adhesive flow control valve 85 is shut off so that only slurry from reservoir 211 is controllably fed to depositor 80. The slurry is deposited onto the conductive coating 20 of the Mylar carrier strip 10 as it moves therepast in a desired striped pattern like that shown in FIG. 7. Following depositor 80, the as-deposited phosphor slurry stripes are then cured first from the bottom (10*b*) by U.V. lamp 72 which is movable to the position shown in phantom for operation of the apparatus in this mode and then cured from the top (side 10*a*) by U.V. Lamp 92. This curing sequence is preferred to insure a fully cured layer. Any suitable means may be used to move lamp 72 to the phantom position shown. The phosphor slurry applied in this mode is of the type described in the aforementioned U.S. Pat. No. 4,534,743, the teachings of which are incorporated by reference. The phosphor slurry is thus a slurry of uncured epoxy resin and phosphor particles (400 mesh) having a viscosity of 10,000 CPS. Preferably, the epoxy component of the slurry is epoxy known commercially as "Magnacryl UV 2632", referred to hereinabove.

Once the slurry stripes are cured by lamps 72, 92 to form multiple side-by-side electroluminescent layers or stripes 101, the carrier strip is fed past the aluminum depositor 110 or the strip is coiled and sent to a vendor for deposition of aluminum layers 112 on the electroluminescent stripes or layers of cured slurry side of the cured slurry layer opposite from the conductive layer 20 to form multiple electroluminescent panel strips 210–214 which can be further processed to form multiple finished lamps as explained below.

Figure 9:
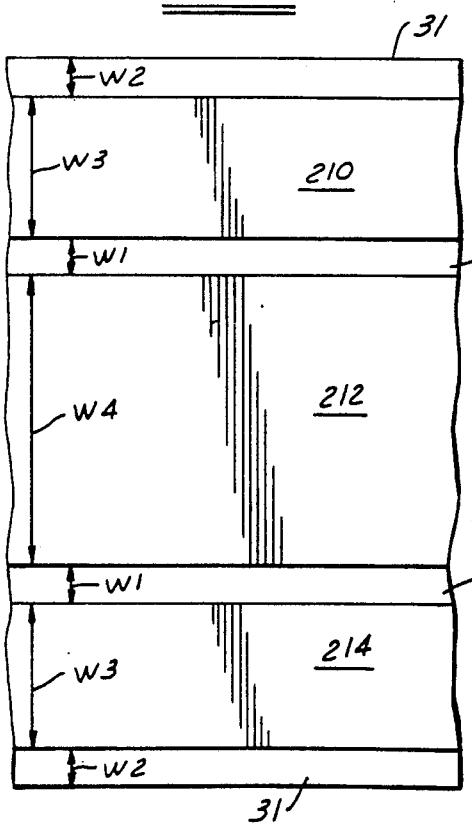
FIG. 9 is a plan view of a partial length of carrier stripe after deposition of the aluminum rear electrode layer on each electroluminescent stripe.

The processed carrier strip 10 with first conductive layer 20 and multiple side-by-side electroluminescent panel strips 210, 212, and 214 is shown in FIG. 9.

Figure 10:
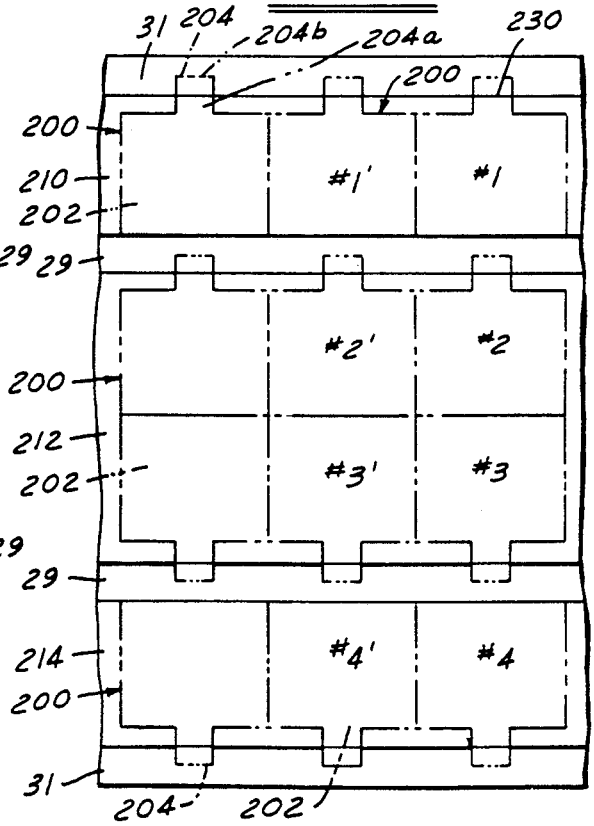
FIG. 10 is a plan view similar to FIG. 9 wherein the outline of the panel lamps to be cut from the strip are superimposed thereover.

FIG. 10 illustrates how multiple parallel plate type electroluminescent panel lamps can be cut from the strip of FIG. 9. In particular, the outlines 200 of a particular shape rectangular electroluminescent lamp are shown superimposed on the strip. It is clear that each panel lamp includes a main rectangular (in plan) body portion 202 and a electrical connector tab or portion 204 extending from the main body.

As shown, each main body 202 is disposed within a particular electroluminescent panel strip 210, 212, 214 formed of the first and second conductive layers with the electroluminescent layer therebetween. The central panel strip 212 is double the width of the side panel strips 210, 214 so that two panel lamps can be cut therefrom.

The main body 202 of each lamp is shown extending with its longest dimension along the length of the strip. However, this is not essential.

The electrical connector tab 204 of each lamp extends transverse to the main body through a portion of the respective strip 210, 212, 214 and through a portion of the respective space 29,31. As a result, when the lamp outlines are cut from the strip, each tab 204 will include an innermost portion 204*a* comprised of the respective panel strip (i.e., first and second conductive layers and intermediate electroluminescent layer or carrier strip 10) and outer portion 204*b* of exposed first conductive layer 20 side-by-side on the tab. The exposed portion of panel strip and exposed portion of first conductive layer 20 have a juncture or interface 230 extending substantially parallel with the long dimension of the main body and carrier strip.

Figure 11:
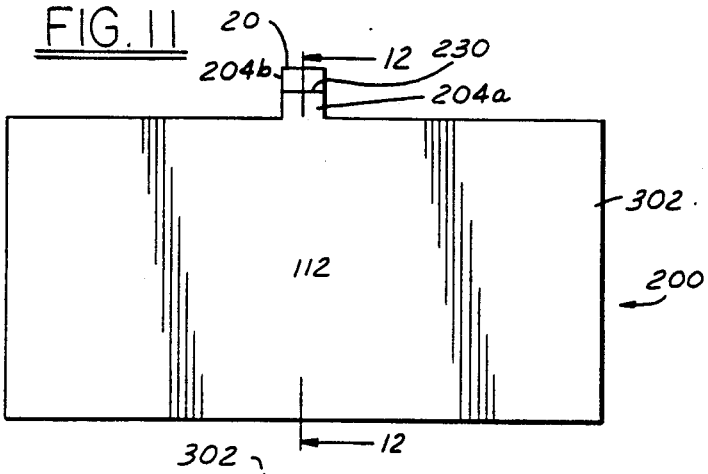
FIG. 11 is a plan view of a parallel plate type of electroluminescent panel lamp cut from the processed carrier strip of FIG. 10.
Figure 12:
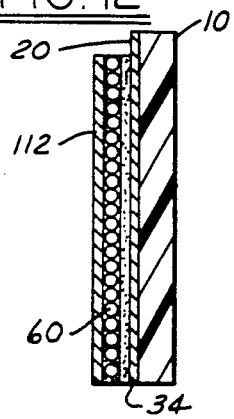
FIG. 12 is a cross-sectional view along line 12—12 of FIG. 11 with the thickness greatly exaggerated.

One of the multiple panel lamps 200 cut from the processed strips of FIG. 9 is shown in FIG. 11 with the main rectangular (in plan) body 202 and integral electrical connector tab 204 having the inner exposed panel strip portion 204*a* and outer exposed first conductive layer 20 on the tab.

Cutting of the panel lamp outlines 200 from the panel strip of FIG. 9 can be effected by conventional cutting techniques but die cutting using a punch and die is preferred. The panel lamp outlines can be individually cut from the processed strip or multiple lamp outlines can be cut simultaneously. Multiple panel lamp outlines; e.g., lamps #1,#2,#3,#4, aligned or transverse to the length of the strip can be die cut simultaneously or successively and the strip can then be advanced to align the next set of panel lamps #1',#2',#3',#4' for cutting.

Figure 13:
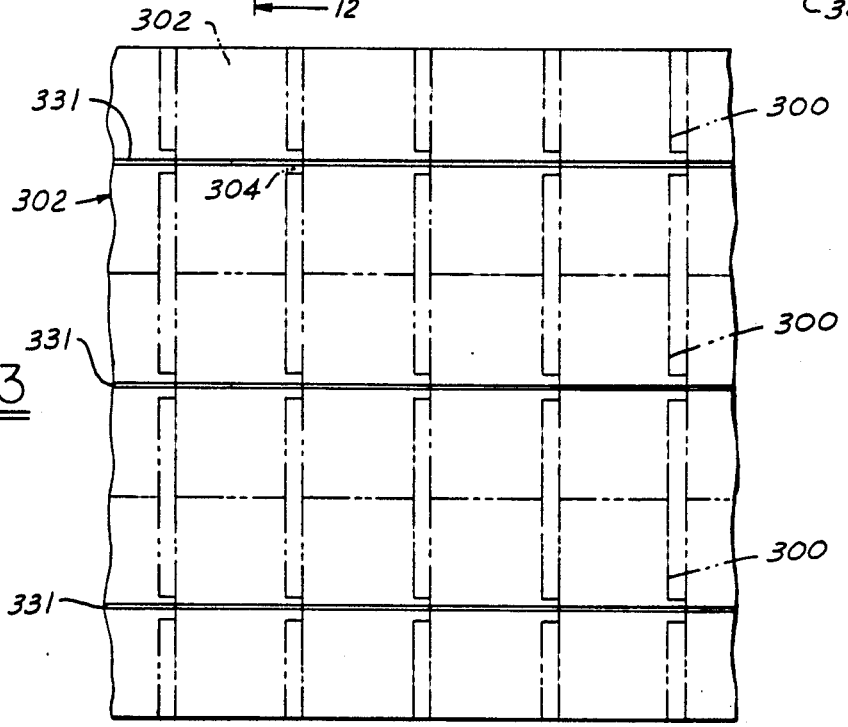
FIG. 13 is a plan view of a carrier strip processed to form a split electrode type of electroluminescent panel with outlines of panel lamps to be cut from the strip superimposed thereover.
Figure 14:
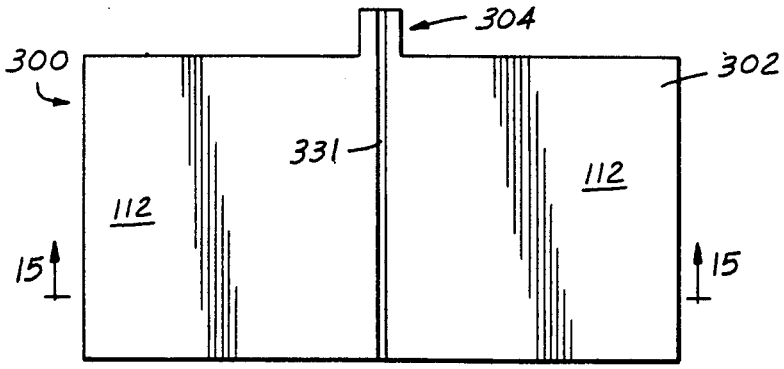
FIG. 14 is a plan view of cut-out split electrode panel lamp with the rear electrode split apart.

FIGS. 13 and 14 illustrate how multiple split electrode type electroluminescent lamp outlines 300 can be cut from a processed strip 301 having narrow grooves 331 in aluminum layer 112. The processed strip 301 would be applying a first conductive layer 20 and electroluminescent layer 101 (i.e., comprising first dielective layer 34, phosphor layer 60 and second dielectric layer 84) uniformly on carrier strip 10 without spaces of the type referred to as 29,31 hereinabove by the process described in the aforementioned copending application Ser. No. 940,794 of common inventorship herewith, the teachings of which are incorporated herein by reference.

Only the rear aluminum layer or electrode contains spaces or grooves 331 through it. The other layers of the electroluminescent panel strip are not grooved but instead are uniform across their width and length as described in the above-referenced copending application.

The grooves 331 can be formed in the aluminum layer 112 by techniques described in that above-referenced copending application. Alternatively, the groove 331 through layer 112 can be formed by mechanically scribing the layer, either before or after the lamp outline is cut from the strip. Also, it is within the scope of the invention to form groove 331 in and through first layer 20 in lieu of rear layer 112.

Cutting of the panel lamp outlines 300 from the strip of FIG. 13 can be effected in the same manner as described hereinabove for the parallel plate panel lamps of FIG. 11.

However, it is clear that in FIG, 13 that the main body 302 of the split electrode lamp outline extends transverse to the long dimension of the carrier strip and is centered about the respective groove 331 to divide the rear layer or electrode 112 into equal portions but electrically separate. The projecting integral electrical connector tab 304 likewise is centered about the respective groove 331 so that the tab includes equal portions of aluminum layer 112 that are electrical separate. The tab 304 of each split electrode panel lamp 300 is shown extending integrally from the main body 302 transverse thereto and along the long dimension of the carrier strip.

Figure 15:
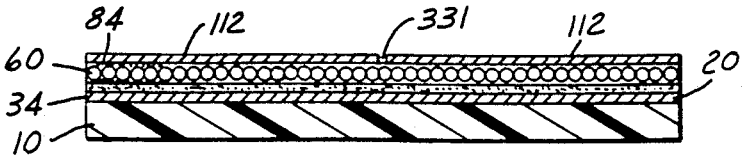
FIG. 15 is a cross-sectional view along line 15—15 of FIG. 14.

One split electrode panel lamp cut from the strip of FIG. 13 is shown in FIGS. 14 and 15 with main rectangular (in plan) body 302 and integrally extending tab 304, both of which have aluminum layer 112 split apart by groove or space 331 therethrough.

The tab 204 of the parallel plate type electroluminescent panel lamp 200 illustrated in FIG. 11 and the split tab 304 of the split electrode type electroluminescent panel lamp 300 of FIG. 14 provide integral electrical connector means adapted for electrically coupling or engaging to the same or so-called universal connector 400 shown in FIGS. 16–19 to provide the desired AC driving voltage across the first and second conductive layers 20,112 for the parallel plate panel lamp and to the split portions **112*a*,112*b* of the aluminum layer 112** for the split electrode type panel lamp.

The electrical connector 400 includes an electrical insulating body 402 made of polyester and first and second resilient metallic contacts fingers 404, 406, both of which terminate in oval (in elevation) contact surfaces **404*a*,406*a* adapted to resiliently engage against the tabs 204 or 304** of the respective parallel plate or split electrode panel lamp as will be explained.

Each contact finger 404, 406 terminates in a respective end inside the body 402 where it is connected to electrical lead wires 410, 412 extending from the connector to a source of AC driving voltage.

Figure 16:
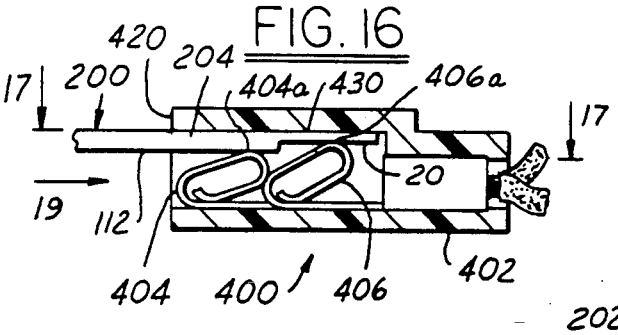
FIG. 16 is a side elevation, with the connector housing broken away, of an electrical connector useable with either the parallel plate type or split electrode type of panel lamp of the invention.
Figure 17:
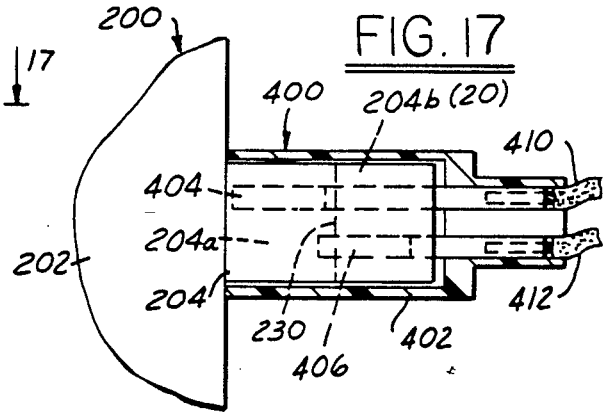
FIG. 17 is a sectional view in the direction of arrows 17 of the electrical connector engaged to the electrical connector tab of a parallel plate panel lamp of the invention.
Figure 18:
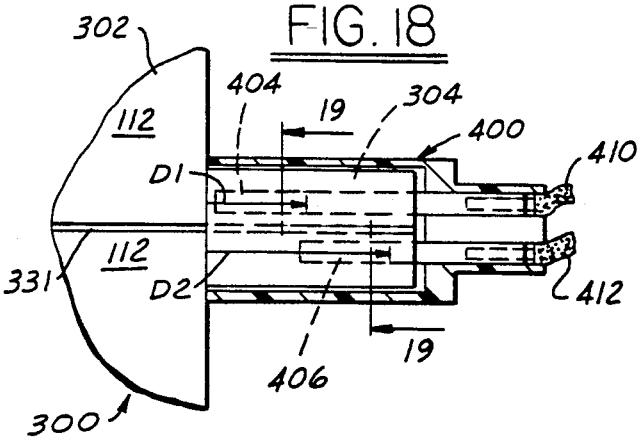
FIG. 18 is a plan view of the same electrical connector engaged to the electrical connector tab of a split electrode panel lamp of the invention.

As is best seen in FIG. 16, the contacts 404, 406 as well as their respective contact surfaces **404*a*,406*a* are disposed at different lengths or longitudinal distances D1,D2 from the outer end 420 of the connector body. The contact fingers 404,406 are also laterally spaced apart by a lateral distance DL along their lengths. This orientation of contact fingers 404,406 relative to one another is selected to make the connector useful for engaging the tab 204 of the parallel plate panel lamp and the tab 304 of the spirit electrode panel lamp as explained next. FIGS. 17–18 illustrates the electrical connector 400 electrically coupled to the tab 204 of parallel plate panel lamp 200. It can be seen that contact surface 404*a* of the contact finger 404 engages the exposed portion 204*a* of the panel strip composed of the first conductive layer 20, electroluminescent layer 101 and second conductive layer 112 while the contact surface 406*a* of the contact 406 engages against the exposed portion 204*b* comprising exposed first conductive layer 20 (ITO). A driving voltage can thus be generated across the front conductive layer 20 and rear conductive layer 112 with the electroluminescent layer 101 therebetween to drive the layer 101** to luminesce.

As shown best in FIG. 16, contact surfaces **404*a*,406*a* are spaced from inner wall 430 of the electrical connector body 402 a selected distance slightly less than the thickness of the exposed portion 204*b* so that an effective friction contact is made by the contact surface 406*a* with the exposed portion 204*b* layer and by contact surface 404*a* with aluminum layer 112 on exposed portion 204*a***.

Figure 19:
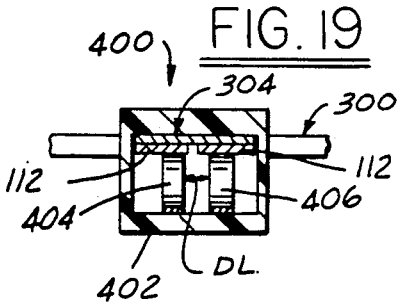
FIG. 19 is a sectional view of FIG. 16 along lines 19.

Referring now to FIGS. 18–19, the same electrical connector is shown electrically engaged on tab 304 of split electrode panel lamp 300. It is clear that the lateral spacing or distance DL between contact fingers 404,406 is selected to place one contact 404 on one side portion of the split aluminum layer 112 and the other contact 406 on the opposite side portion thereof in frictional electrical contact. The difference in length of contact fingers 404,406 is selected that each contact surface **404*a*,406*a* frictionally engages one side portion on the tab 304. In this way, an AC driving voltage can be applied between the split apart portions of the rear aluminum layer 112** to operate the panel lamp in accordance with the teachings of U.S. Pat. No. 4,534,743 referred to hereinabove, the teachings of which are incorporated herein by reference.

While there have been described in the foregoing specification the best and preferred mode for carrying out the invention, it is my intent to cover in the appended claims all modifications thereof as fall within the spirit and scope of the invention as set forth in the appended claims.

I claim:

1. An electroluminescent panel lamp comprising: a main body having a thickness including a first conductive layer, second conductive layer and electroluminescent layer there between and including an integral electrical connector tab contiguous with and extending from the main body in a direction substantially perpendicular to said thickness dimension with at least a portion of the integral electrical connector tab having said first conductive layer and second conductive layer with the electroluminescent layer there between, each layer in said portion of said tab being in the same plane as the corresponding layer consisting of the same material in the main body and at least one of said first and second conductive layers in said integral electrical connector tab defining a direct electrical and physical connection and the other of said first and second conductive layers in said integral electrical connector tab defining a second direct electrical and physical connection for said lamp.

2. The lamp of claim 1 wherein the electrical connector tab includes said portion and another portion having the first conductive layer exposed for electrical connection thereto to define a parallel plate electroluminescent lamp.

3. The lamp of claim 2 wherein said portion is proximate the main body on the tab and said another portion is distally located relative to the main body.

4. The lamp of claim 2 wherein said portion and another portion form an interface substantially parallel with said thickness dimension of the main body.

5. The lamp of claim 1 wherein the tab includes said portion with a groove through one of said first and second conductive layers of said portion to form split apart portions and the main body includes a groove through said one of said first and second conductive layers to define a split electrode electroluminescent lamp.

6. The lamp of claim 5 wherein the groove of the tab and the groove of the main body are contiguous.

7. The lamp of claim 2 further including a pair of electrical contacts engaged to said tab with one of the contacts engaged to said portion and the other of the contacts engaged to said another portion and connected to a source of driving voltage so that said voltage can be applied between said first conductive layer and second conductive layer.

8. The lamp of claim 7 wherein the contacts are different in length.

9. The lamp of claim 5 further including a pair of electrical contacts engaged to said tab with one of the contacts engaged to one of said split apart portions on the tab and the other of the contacts engaged to the other of said split apart portions on the tab.

10. The lamp of claim 1 wherein the electrical connector tab includes said portion adjacent the main body and another portion remote from the main body along the length of the tab with said another portion having the first conductive layer thereon and exposed for electrical connection thereto.

11. The lamp of claim 10 further including an electrical connector attached to the electrical connector tab, said connector having an insulating body with an open-ended recess in which the tab is received and a pair of spaced apart contacts of different length such that one contact engages said portion on the tab adjacent the main body and the other contact engages said another portion on the tab remote from the main body along the length of the tab.

12. The lamp of claim 1 wherein the main body and tab have a groove through one of said first and second conductive layers to form laterally split apart conductive portions on the main body and tab with said split apart conductive portions on the tab extending along the length thereof.

13. The lamp of claim 12 further including an electrical connector attached to the electrical connector tab, said connector having an insulating body with an open-ended recess in which the tab is received and a pair of contacts spaced laterally apart a distance greater than the lateral width of the groove so that one contact engages one of the split apart conductive portions on the tab and the other contact engages the other of the split apart conductive portions on the tab.

14. An electrical connector for use with electroluminescent panel lamps of different types wherein one type has an electrical connector tab with first and second conductive contact portions at different locations along the length of the tab and another type has first and second conductive contacts spaced laterally apart by a groove on the tab, said connector comprising an insulating body having an open-ended recess to receive the tab of either type of electroluminescent panel lamp and a pair of contact fingers spaced apart by a distance greater than the lateral width of the groove but less than the lateral width of the tab and of different selected lengths whereby when the tab of said one type of panel lamp is received in the recess, one of the contact fingers engages one of the first and second conductive contact portions and the other of the contact fingers engages the other of the first and second conductive portions at a different location along the length of the tab and when the tab of said another type is received in the recess, one of the contact fingers engages one of the laterally spaced first and second conductive contact portions and the other of the contact fingers engages the other of the laterally spaced first and second conductive contact portions.

15. An electroluminescent panel lamp comprising:

a main body having a thickness including a first conductive layer, second conductive layer and electroluminescent layer therebetween and including an integral electrical connector tab extending from the main body with a portion of the electrical connector tab adjacent the main body having said first conductive layer and second conductive layer with the electroluminescent layer there between and another portion remote from the main body having the first conductive layer thereon and exposed, and an electrical connector attached to said integral electrical connector tab, said connector having an insulating body with an open-ended recess in which the tab is received and a pair of spaced apart contacts of different length such that one contact engages said portion on the tab adjacent the main body and the other engages said another portion on the tab remote from the main body along the length of the tab.

16. An electroluminescent panel lamp comprising:

a main body having a thickness including a first conductive layer, second conductive layer and electroluminescent layer therebetween and including an integral electrical connector tab extending from the main body with a portion of the electrical connector tab adjacent the main body having said first conductive layer and second conductive layer with the electroluminescent layer therebetween, the main body and tab having a groove through one of said first and second conductive layers to form laterally split apart conductive portions in one of said first and second conductive layers on the main body and tab with said split apart conductive portions on the main body and tab extending along the length thereof, and an electrical connector attached to the integral electrical connector tab, said connector having an insulating body with an open-ended recess in which the tab is received and a pair of contacts spaced laterally apart a distance greater than the lateral width of the groove so that one contact engages one of the split apart conductive portions on the tab and the other contact engages the other of the split apart conductive portions on the tab.

17. An electroluminescent panel lamp comprising:

a main body having a thickness including a first conductive layer, second conductive layer and an electroluminescent layer therebetween and including an integral electrical connector tab extending from the main body with a portion of the electrical connector tab adjacent the main body having said first conductive layer and second conductive layer with the electroluminescent layer therebetween wherein said connector tab includes said portion having a groove through one of said first and second conductive layers of said portion to form split apart portions and the main body including a groove through said one of said first and second conductive layers.

18. An electroluminescent panel lamp comprising:

a main body having a thickness including a first conductive layer, second conductive layer and an electroluminescent layer therebetween and including an integral electrical connector tab extending from the main body with a portion of the electrical connector tab adjacent the main body having said first conductive layer and second conductive layer with the electroluminescent layer therebetween wherein said tab includes said portion with a groove through one of said first and second conductive layers of said portion to form split apart portions and the main body includes a groove through one of said first and second conductive layers wherein the groove of the tab and the groove of the main body are contiguous.

19. An electroluminescent panel lamp comprising:

a main body having a thickness including a first conductive layer, second conductive layer and an electroluminescent layer therebetween and including an integral electrical connector tab extending from the main body with a portion of the electrical connector tab adjacent the main body having said first conductive layer and second conductive layer with the electroluminescent layer therebetween wherein said tab includes said portion with a groove through one of said first and second conductive layers of said portion to form split apart portions and the main body includes a groove through said one of said first and second conductive layers further including a connector having a pair of electrical contacts engaged to said tab with one of the contacts engaged to one of said split apart portions on the tab and the other of the contacts engaged to the other of said split apart portions on the tab.

20. An electroluminescent panel lamp comprising:

a main body having a thickness including a first conductive layer, second conductive layer and an electroluminescent layer therebetween and including an integral electrical connector tab extending from the main body with a portion of the electrical connector tab adjacent the main body having said first conductive layer and second conductive layer with the electroluminescent layer therebetween wherein the main body and tab have a groove through one of said first and second conductive layers to form laterally split apart conductive portions on the main body and tab with said split apart conductive portions on the tab extending along the length thereof.

* * * * *